US006919542B2

(12) United States Patent
Galliou et al.

(10) Patent No.: US 6,919,542 B2
(45) Date of Patent: Jul. 19, 2005

(54) SHEATHED HEATING ELEMENT WITH POSITIVE TEMPERATURE COEFFICIENT

(75) Inventors: Henri Galliou, Plombieres les Bains (FR); Olivier Moine, Aix les Bains (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 10/689,734

(22) Filed: Oct. 22, 2003

(65) Prior Publication Data

US 2004/0084439 A1 May 6, 2004

(30) Foreign Application Priority Data

Oct. 23, 2002 (FR) ..... 02 13251

(51) Int. Cl.[7] ..... H05B 3/68
(52) U.S. Cl. ..... 219/468.2; 219/544
(58) Field of Search ..... 219/443.1, 444.1, 219/465.1, 467.1, 468.1, 468.2, 544, 546, 547, 548, 523; 338/230, 233, 243, 252

(56) References Cited

U.S. PATENT DOCUMENTS 2,499,961 A * 3/1950 Lennox ..... 219/541
2,767,288 A 10/1956 Lennox
2,816,200 A * 12/1957 Mudge ..... 174/102 R
2,916,594 A * 12/1959 Sawyer ..... 219/548
3,885,128 A * 5/1975 Dills ..... 219/455.12
4,052,590 A * 10/1977 Anderl et al. ..... 219/438

FOREIGN PATENT DOCUMENTS

GB 2 308 537 A 6/1997

* cited by examiner

*Primary Examiner*—Sang Y. Paik
(74) *Attorney, Agent, or Firm*—Browdy and Neimark, P.L.L.C.

(57) ABSTRACT

A heating element for an electric appliance for heating or cooking foods. The heating element is composed of: a tubular metal envelope; and a resistance wire encased in an insulator disposed at the interior of the tubular envelope. The wire is composed of nickel and iron as the two principal elements, and has a temperature coefficient α greater than 1500 ppm/° C. The wire may be wound in a spiral and the outer diameter of the spiral is greater than 0.7 times the inner diameter of the tubular envelope.

19 Claims, 2 Drawing Sheets

SHEATHED HEATING ELEMENT WITH POSITIVE TEMPERATURE COEFFICIENT

BACKGROUND OF THE INVENTION

The present invention relates to the field of heating elements of the sheathed type in which a resistance wire encased in an insulator is housed in a metal tube. The insulator may be made of a material such as magnesia. The present invention relates in particular to elements of this type having particular electrical characteristics.

It is known, in appliances of the water heater type, to utilize resistance heating elements whose resistance presents a significant thermal coefficient, i.e. experiences a significant increase in resistance when the temperature increases. This characteristic is known as a positive temperature coefficient (PTC).

This characteristic is expressed by the formula:

$$\rho=\rho_o[1+\alpha(T-25)]$$

where $\rho_o$ is the resistivity of the wire at 25° C., $\rho$ is the resistivity of the wire at the temperature T expressed in ° C., and $\alpha$ is the temperature coefficient.

This property results in a reduction in the power converted to heat, or dissipated, in these elements, since this power is given by the equation $P=V^2/R$, where V is the supply voltage and R is the resistance of the heating element directly linked to the value of its resistivity.

These heating elements are, however, operated, to be fully on or fully off, i.e. to provide thermal safety that avoids all malfunction. Variation of the resistance is of the order of 25% between around 20° C. and 800° C., which permits generating power decreases of 25%, sufficient for standard tests.

Moreover, the heating wires currently used in heating elements for household electrical cooking appliances, in which the maximum temperature of the hotplates, or hotplates, is of the order of 300° C., present a variation of the order of 10% for wires of the Ni—Cr or Ni—Cr—Al type.

The PTC effect thus has only a small influence on the operation of the appliance. It appears, however, to take advantage of this effect, for purposes of protection and/or regulation of the appliances.

U.S. Pat. No. 2,767,288 discloses a heating element having a heating wire with a temperature coefficient at least equal to 0.003. The heating element offers an improvement in heat transfer at the level of heating element, through a double tube, the interior tube being made of a material having a high thermal conductivity, such as copper, and the outer tube being resistant to corrosion.

If such an element permits an automatic limitation of the power when the temperature rises, its use is limited to a substantial temperature range and for a heating of objects located at a distance from the heating element, or in contact with the material to be heated only at certain points.

Production of such a heating element remains however difficult due in part to the materials used for the two tubes. In addition, such an arrangement has the disadvantage of allowing only poor contact between the heating element and the material to be heated.

BRIEF SUMMARY OF THE INVENTION

The present invention serves to overcome the disadvantages mentioned above.

The invention provides a heating element for electric appliances for heating or cooking foods, the heating element having a tubular metal envelope at the interior of which is housed a resistance wire encased in an insulator, the two principal elements constituting the wire being nickel and iron, the wire having a temperature coefficient $\alpha$ greater than 1500 ppm/° C., and preferably greater than 3000 ppm/° C., wherein the wire is wound in a spiral form and the outer diameter of the spiral is greater than 0.7 times the inner diameter of the tubular envelope.

The present invention thus provides heating elements having a substantial PTC with a resistance value at high temperature, for example at 300° C., that can reach several times the initial value at ambient temperature. By such an effect, and when supplying electrical power to such heating elements, in proportion to their heating, the resistance will increase and consequently the power converted into heat will decrease, until being stabilized at a certain temperature that depends, to a first approximation, on the magnitude of the PTC effect as well as the thermal transfer conditions.

By utilization of wires having such values of temperature coefficient $\alpha$, it can be envisioned to obtain a stabilization temperature of the heating element substantially identical to that obtained with the aid of a specific regulation device having for example temperature probes associated with means for turning off the supply of electric power to the heating element.

However, one of the consequences of utilization of wires having a high temperature coefficient $\alpha$ is their low initial resistivity at ambient temperature. A lower resistivity value requires either that the length of the heating wire be increased or that the cross-section of the wire be reduced to achieve an adequate value for the resistance $R_0$ of the wire at ambient temperature. This influences the value R at a given temperature, based on the temperature coefficient $\alpha$. In effect, the equation linking resistance to resistivity is given by:

$$R=\rho\frac{l}{s}$$

where R is the resistance, $\rho$ the resistivity of the wire, l the length of the wire, and s its cross-section. Thus, to increase the resistance, one can either increase the length of the wire or reduce its cross-section.

One of the constraints linked to increasing the length of the wire is that it requires lengthening the tubular envelope, which increases the manufacturing cost and can generate an increase in the size of the hotplates and thus of the appliance, resulting in excessive cost increases.

These disadvantages can be reduced if a longer length of wire can be housed in a given volume enclosed by the tubular envelope.

One of the means for achieving this consists in winding the wire in the form of a spiral having an outer diameter that is greater than 0.7 times the inner diameter of the tubular envelope. It is in effect the usual practice to wind a wire in a spiral at the interior of a tubular envelope, but with an outer diameter of the spiral that does not exceed 0.6 times the inner diameter of the tubular envelope. It is advisable, however, to maintain a minimum distance of 0.8 mm to 1 mm between the wire and the tubular envelope.

A relative increase in the diameter of the spiral relative to the inner diameter of the tubular envelope thus permits an increase in the total length of the wire for a tubular envelope occupying a given amount of space.

Moreover, when the diameter of the coil relative to the inner diameter of the tubular envelope is increased, the thickness of the insulating coating is reduced, which permits the thermal transfer between the resistance wire and the tubular envelop to be increased.

Other techniques can be used to house a greater length of wire in the tube and to thus limit the increase in the overall size of the element: tighter winding, concentric turns, coaxial turns, double spiral, etc . . . .

According to a particular characteristic of the invention, the proportion of nickel in the composition of the wire is greater than 40%. This value permits wires having elevated temperature coefficients to be obtained.

The invention also provides for the construction of an electric appliance for heating or cooking foods, having at least one heating plate, or hotplate, for the foods, the plate being coupled with a heating element having a tubular metal envelope at the interior of which is housed a resistance wire encased in an insulator, wherein the two main constituent elements of the wire are nickel and iron, and in which the wire has a temperature coefficient $\alpha$ greater than 1500 ppm/° C. and preferably greater than 3000 ppm/° C.

The temperature range being relatively small, of the order of 300° C., because the appliances are for cooking foods, it will be desirable that the heating resistance have a high temperature coefficient, while being careful that the use of a heating element having such a wire does not result in a substantial increase in the cost of such an element, and is compatible with practical construction of the household electric appliance.

The provision of a hotplate is, however, conditioned by the thermal exchanges between the heating element and the plate. This is that much more important when the equilibrium temperature is dependant on the load on the hotplate, i.e. of the quantity of food to be cooked. The hotplate must then be in intimate contact with the heating element in order for the PTC effect to play its full role.

Advantageously, the hotplate conforms to one of the characteristics described earlier herein.

Advantageously, the resistance of the wire is adjusted so that the heat generated by the supply of electric power to the heating element provokes an increase in the resistance of the wire up to an equilibrium value corresponding to a temperature of the hotplate that is the operating temperature of the hotplate to heat or cook foods within cooking appliances of the sandwich grill, waffle maker, meat grill, etc. type. This temperature is usually regulated in existing appliances by a thermostat having a temperature probe associated with means for turning off the supply of power to the heating element.

The present invention serves more particularly to eliminate a thermostat for regulation of the heating elements equipping certain electric cooking appliances, while assuring a regulation of the heating elements without a separate regulating device.

The PTC effect should be large since, it being a matter of regulating food cooking appliances, the temperature difference is much lower than in the case of water heater malfunctions.

By this characteristic, when the heating element is supplied with power, it heats the hotplates, which leads to an increase in the resistance of the heating wire. The plate is thus heated less and less in proportion as its temperature rises. A thermal equilibrium is thus rapidly obtained. By carefully selecting the resistance of the wire, the thermal equilibrium temperature of the wire, and thus of the hotplate, can be adjusted. Stated in other terms, such an appliance no longer represents a temperature regulation of the hotplate, this being self-regulated by the PTC effect of the wire constituting the core of the heating element.

However, it is necessary to find a compromise between the value of the PTC effect and the value of the initial resistivity of the wire since, as already mentioned earlier herein, the greater the PTC effect, the lower must be the initial resistivity.

According to another version of the characteristics of an electric appliance according to the present invention, the power converted to heat by the heating element at the temperature required by the plate for heating or cooking foods is between 0.4 and 0.7 times the power converted to heat by the heating element at ambient temperature for a given supply voltage to the heating element.

According to the present invention, the power variation is uniquely due to the thermal variation of the heating resistance resulting from the value of the temperature coefficient $\alpha$.

Advantageously, the electric appliance for heating or cooking foods according to the present invention has means that aid thermal exchange between the heating element and the hotplate.

In effect, the goal being achievement of a household electric appliance, the wire, even if it is at the heart of the problem, does not constitute the sole parameter to which attention must be paid in order that, globally, there is obtained a thermal self-regulation of the appliance. In effect, when an appliance having hotplates, of the sandwich grill or waffle maker type, is supplied with power, the power is at a high level at the start of use of the appliance until stabilization of the temperature of the plates when there is no food thereon. Then, when the food is placed on a plate, the temperature of the plate drops. The entire operation of the device then resides in this temperature drop and the return of power that must follow, over a narrow temperature range of, for example, around 50° C.

This return or increase of operating power is necessary for proper cooking to be achieved. The increase or return of power is an important parameter that is a function of small variations in the wire, but also, by way of summary, the thermal exchanges between the wire and the hotplate since this return of power can only take place if the information about the temperature drop of the plates arrives at the heating wire.

One of the means for aiding thermal exchange consists in arranging, in the hotplate, a groove for housing the heating element, which permits a more intimate connection between the heating element and the hotplate.

Advantageously, the groove surrounds the heating element around at least one-half of the perimeter of the tubular envelope of said heating element.

According to a variation of the housing of the element in the groove of the hotplate, the heating element undergoes a compression step in the groove in order to increase the surface area of contact between the heating element and the groove.

It is possible to improve the thermal exchanges between the heating element and the hotplate by modifying the thermal emission characteristics of the heating element so that the parts of the heating element in contact with the hotplate having a surface emissivity greater than the parts that are not in contact with the hotplate. Radiation from the rear part of the heating element is thus reduced.

A complementary method for augmenting the thermal transfer from the heating element toward the plate is to cover the parts that are not in contact with the plate with a diffusion plate of a material that is a good thermal conductor, such as aluminum or copper. Preferably, this diffusion plate is equally in contact with the hotplate in that it extends over a significant surface area of the hotplate, for example of the order of 30% of the total surface area of the hotplate.

Another means for aiding the transfer of energy from the heating element toward the hotplate is to position the resistive wire eccentrically at the interior of the tubular envelope, so that the wire is closer to the hotplate. Thus, due to an increase in the thermal exchanges between the heating element and the hotplate, the heating element responds more quickly to any variation in temperature of the hotplate, leading automatically to a modification of the power that it dissipates.

This principle of self-regulation produces other advantages:

- a better reactivity, by the reduction of the load on the wire at high temperature,
- a better aging of the heating elements by reducing the number of power supply interruptions relative to conventional regulation that places stresses on solder joints,
- possible elimination of a fuse.

BRIEF DESCRIPTION OF THE DRAWINGS

The following drawing figures provide a non-limiting example of an embodiment of the present invention.

DETAILED DESCRIPTION OF THE INVENTION

The present invention will be described with reference to a cooking appliance of the sandwich grill or waffle maker type having heating elements based on wires having a substantial PTC effect. As indicated earlier herein, attainment of a substantial PTC effect is linked essentially to the choice of the material constituting the resistance wire, and notably its temperature coefficient. Among the numerous data available for wires, the selection according to the invention is directed to wires having a temperature coefficient $\alpha$ comprised between 0.0015 and 0.0050, which corresponds to a relative resistance increase of 1500 to 5000 ppm/° C. Stated in other terms, a temperature increase of 300° C. leads to an increase in resisitivity, and thus in increase in resistance, of the heating wire by a factor comprised between 1.4 and 2.4, which results, at this temperature, in a power drop in the same ratio.

A value lower than 0.0015 would thus not have a sufficiently large PTC effect, and a value higher than 0.005 would cause feasibility problems for the heating element and/or the cooking appliance.

In effect, such a temperature coefficient variation leads to low resistivity values, of the order of 0.2 Ω.mm instead of one 1 Ω.mm for conventional wires. The two parameters that can be varied to provide the nominal resistance value are the length of the wire, which increases the value as the length increases, and/or the cross-section of the wire, an increased cross-section resulting in a reduced resistance.

However, it is necessary to keep in mind that an increase in the length of the wire leads to an increase in the thermal exchange surface, which can lead to a departure from the typical load curve of the wire.

Moreover, wire diameters of 0.18 mm or even 0.14 mm, have thus been used, compared to the usual diameters of 0.25 to 0.30 mm.

Figure 1:
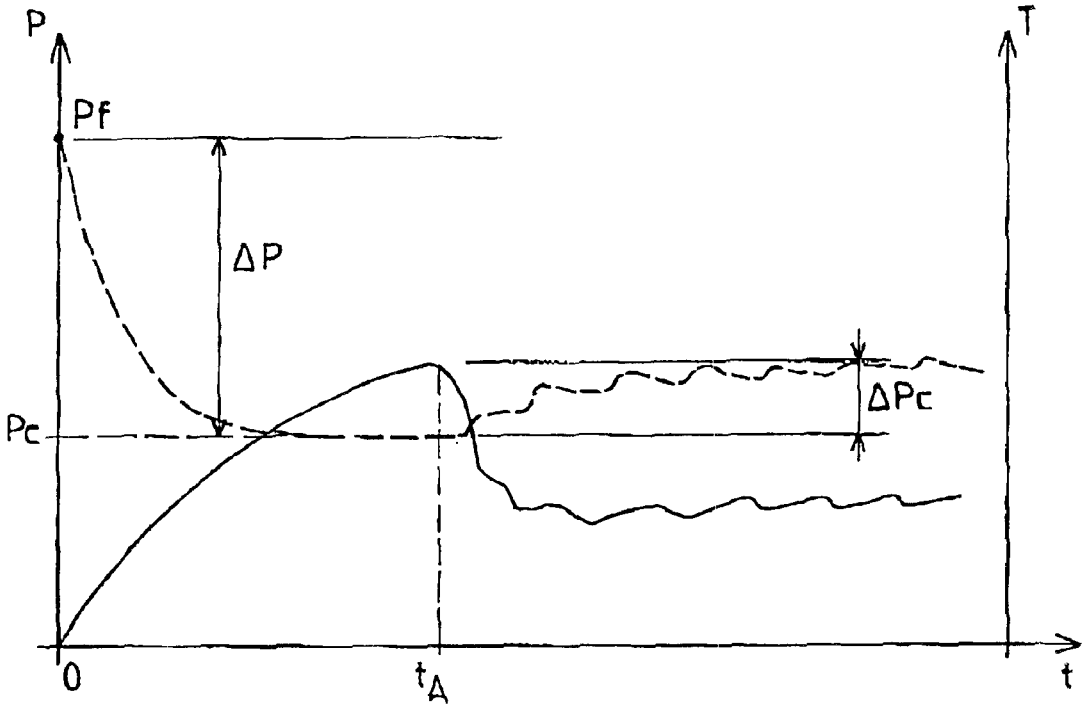
FIG. 1 is a diagram showing the thermal power generated by a heating element and the resulting temperature of a hotplate in a heating arrangement according to the present invention installed in an electric appliance of the sandwich grill or waffle maker type.

Two typical heating curves are shown in FIG. 1. A first curve, in dotted lines, shows the variation in thermal power generated in the heating elements from the time when the appliance is placed into operation. The second curve, in a solid line, shows the variation in temperature of the hotplate.

Thus, starting from the point at which the heating elements are first supplied with operating power, a substantial cold power, Pf ,is generated. This power is necessary to raise the temperature of the plates. The hotplates being heated, the PTC effect leads to a reduction in the thermal power generated until thermal equilibrium with the plates is achieved. The thermal power thus generated is labeled Pc, representing the power when the hotplates are hot. A first datum to be taken into consideration is thus this power difference Pf–Pc, denoted $\Delta P$, with the percentage power difference being $\Delta P/Pf$. The temperature expected for the hotplates when in operation is determined by the equilibrium power Pc, which is dependant on Pf as a function of the temperature coefficient $\alpha$.

One thus obtains here important information on the value of the temperature coefficient. It is necessary, however, to note that, although the effective "reaction" of the wire making up the heating element can be anticipated by calculations and simulation, actual experience is here necessary to obtain this information since the equilibrium obtained depends also on the thermal exchanges on which it is possible to intervene. The supply voltage of the heating elements can also be modified to adjust the equilibrium temperature of the plates when the equilibrium power is a little too high.

Tests have thus been carried out in which the cold resistance value of various heating elements have been varied in order to determine what cold value is necessary to obtain a given power that produces stabilization around 300° C.

It is important to note that such tests are made difficult by the limits placed on the heating element due to the fact that the space that it occupies must not be substantially increased, the heating element requiring a resistive wire with a temperature coefficient $\alpha$ such as previously described and having a resistance R that permits obtaining a determined power at a given temperature with the limitations such as previously mentioned.

The results of such tests are illustrated in the following table, which presents, starting from different cold power levels, the evolution of the powers as a function of temperature, the heating elements being constituted by a steel tube at the interior of which is housed a wire having a temperature coefficient of 3600 ppm/° C. The different nominal powers are obtained by modifying the length of the wire, essentially by acting on the winding pitch of the wire in the tube.

The table also indicates the variation of power between 160° C. and 210° C., the temperature of 160° C. being estimated to be the temperature of the plate when it receives food to be cooked or heated, and the temperature of 210° C. being estimated to be the temperature of the plate during the course of cooking or heating.

| Power at 25° C. | Power at 160° C. | Power at 210° C. | Power at 300° C. | ΔP 25° C./ 300° C. | ΔP 160° C./ 210° C. |
|---|---|---|---|---|---|
| 1318 W | 708 W | 670 W | 625 W | 693 W | 38 W |
| 1128 W | 605 W | 570 W | 524 W | 604 W | 35 W |
| 977 W | 540 W | 506 W | 461 W | 516 W | 66 W |
| 893 W | 470 W | 440 W | 400 W | 493 W | 30 W |
| 796 W | 430 W | 402 W | 367 W | 429 W | 28 W |
| 754 W | 401 W | 373 W | 335 W | 419 W | 28 W |

In the same conditions, by using tubes of aluminum, the following results are obtained:

| Power at 25° C. | Power at 160° C. | Power at 210° C. | Power at 300° C. | ΔP 25° C./ 300° C. | ΔP 160° C./ 210° C. |
|---|---|---|---|---|---|
| 1060 W | 700 W | 630 W | 542 W | 518 W | 70 W |
| 890 W | 580 W | 520 W | 445 W | 445 W | 60 W |
| 802 W | 500 W | 448 W | 383 W | 419 W | 52 W |
| 700 W | 450 W | 400 W | 335 W | 365 W | 50 W |
| 646 W | 400 W | 356 W | 298 W | 348 W | 44 W |
| 552 W | 355 W | 315 W | 265 W | 287 W | 40 W |

The results show, for steel tubes as for aluminum tubes, a relatively stable value of the ratio between ΔP(25° C./300° C.) and the initial power at 25° C., this value being quite constant, around 0.5, which means that the effect is quite independent of the initial value of power, with slightly higher values for steel than for aluminum. In contrast, aluminum presents a greater power variation between 160° C. and 210° C., linked to a better thermal transfer in aluminum than in steel.

In referring again to FIG. 1, at the instant $t_A$, foods are placed on the plate, which leads to a noticeable decrease in temperature of the plate. This information is conveyed by thermal transfer to the heating wire which thus reacts by undergoing a reduction in resistance, which provokes and increase or return of the power, noted ΔPc.

This return of power determines the quality of the cooking, an insufficient return of power leading to little or no grilling of the product and/or a longer cooking time.

Thus, the value of the return of power Pc is a function:

of slight variations in the wire, of the quality of the powdered insulating material, such as magnesia, and the wire-insulator and insulator-metal tube interfaces;

of thermal exchanges between the metal tube and the hotplate.

One can thus estimate that the wire used provides 60–70% of self-regulation effect and grilling quality, thermal transfers providing between 30 and 40%.

According to a practical example of an embodiment of the invention, an appliance may be one that permits sandwich grilling or waffle making, depending on the form of the hotplates utilized. Its starting power is between 500 and 600 W, while its power when the plates are sufficiently hot is only 250–300 W.

As already mentioned previously, it is necessary to use a wire having a substantial PTC effect. However, it is equally important to have a good thermal conduction between the hotplates and the heating element. In other words, it is necessary to increase or improve the thermal exchanges with relative to appliances containing a regulator. For these latters, in effect, a temperature probe is often linked directly to the cooking plate. Tests performed on such appliances with the wires envisioned show that the thermal exchange can be improved in order to increase the sensitivity of the wire to the temperature variation of the heating pates.

The wire being housed in a tube filled with insulating material, itself in communication with a diffusion plate, connected to the hotplate receiving the product to be cooked, various parameters influencing the thermal transfer between the resistive wire and the food being cooked can be modified, along with the utilization of different resistive wires having different temperature coefficient values.

Of course, preliminary test have taken place for each wire variation, and as specified previously, in order to determine the initial resistance of the heating element to obtain stabilization at an adequate cooking temperature.

Other tests have thus been performed in order to attempt to improve the thermal transfer so that the heating element will be sensitive to variations in the load on the hotplate, and can react rapidly. Certain tests have been performed using heating elements constituted by tubes of aluminum or copper rather than of steel or of stainless steel. Other tests involved improvements in thermal exchanges between the heating element and the hotplate either by the presence, if the cooking plate, or of grooves for housing the heating element, or by the quality of the insulating material encasing the wire in the tube, or by the adaptation of the surface properties of the tube, these different improvements being able to be combined for a more significant effect.

The following table relates to different tests that have been carried out. In the column entitled 'contact with plate', the indication "N" corresponds to a contact such as is normally realized, while the indication "A" corresponds to an improvement in the contact between the heating element and the hotplate, by the provision of a housing groove for the heating element which has an important role in the thermal transfer.

| Temperature Coefficient of the Wire (ppm/° C.) | Type of Tube | Contact with Plate | ΔP 25° C./ 300° C. | ΔPc 160° C./ 210° C. |
|---|---|---|---|---|
| 1350 | steel | N | 167 W | 25 W |
| 1350 | steel | A | 167 W | 30 W |
| 3600 | steel | N | 350 W | 47 W |
| 3600 | steel | A | 350 W | 70 W |
| 3600 | aluminum | A | 270 W | 95 W |
| 4500 | steel | N | 350 W | 58 W |
| 4500 | steel | A | 300 W | 70 W |
| 4500 | Aluminum | A | 300 W | 80 W |

The tests performed show that starting from a wire having a temperature coefficient of 1350 ppm/° C., the power variation, like the return of power, have significant values, respectively 167 W and 30 W in the best case.

The result that follows therefrom on the principle of self-regulation and of cooking of food can thus be envisioned.

Choosing higher values for the temperature coefficient permits choosing a higher cold power, which reduces the heating time of the hotplates. Moreover, subsequent increase in power is (at time $T_A$) higher which improves the quality of cooking of the food.

Moreover, there appear, from the tests performed, and unexpectedly, the following additional advantages with respect to a conventional regulation:

a limited exceeding of the "regulation" temperature, notably a reduction, or even a suppression of the overshooting phenomenon linked to the first temperature peak during regulation, a regulation value that can thus be raised from 10 to 30° C., a reduction in the temperature differential during regulation (separation between the minimum temperature and the maximum temperature around the regulation value), and no increase in power in the case of an overvoltage.

The improvement of the thermal exchanges and the reduction of the thermal inertia between the heating element and the plate can be obtained on the basis of the quality of the tube of the heating element made, for example, of a material having a very good thermal conductivity, such as aluminum, together with an intimate connection between the heating element and the hotplate.

Figure 2:
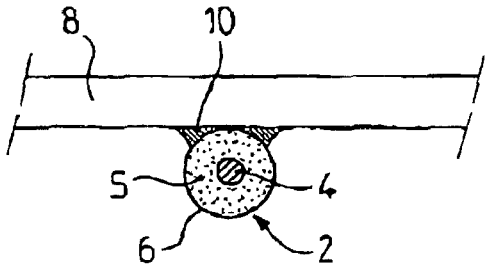
FIGS. 2–5 are cross-sectional detail views showing heating elements according to the invention.

Such as it is currently used, with reference to FIG. 2, heating element 2 has a resistance wire 4 centered in a tubular envelope 6 and encased in insulator 5. This insulator is preferably a mineral insulator, for example an oxide such as magnesia, alumina, or zerconia. Boron nitride can also be used.

Heating element 2 is connected to a hotplate 8 by a brazing band 10. The heat exchange surface between the heating element and the hotplate is relatively small.

Figure 3:
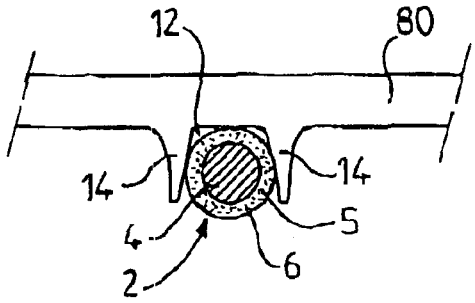
Figure 4:
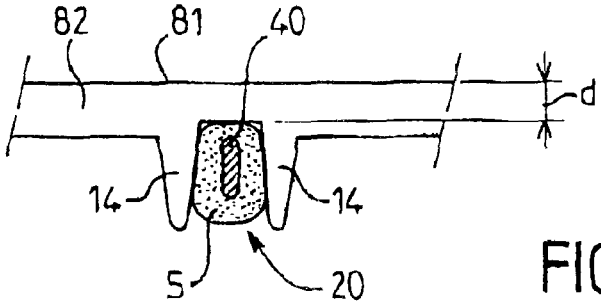

FIGS. 3–6 show different configurations improving the thermal transfer between the heating element and the hotplate. Thus, in FIG. 3, a groove 12 for receiving the heating element is provided in hotplate 80. The groove is delimited by flanks 14. The groove bottom can be flush with the bottom surface of plate 80 as shown in FIG. 3, or can be recessed in from that surface, as shown in FIG. 4. In the case of the embodiment shown in FIG. 4, the distance d between the heating element and the active surface 81 of plate 82 is reduced. FIG. 3 shows that wire 4 is wound in a spiral having a diameter larger than the diameter of the wire itself. This permits a longer wire to be housed in a tubular envelope having a given diameter.

In FIG. 4, heating element 20 is made to conform to the form of the groove, for example by deformation, which permits a further increase in the contact area between the heating element and the hotplate.

Jointly with the shaping of the wire to the shape of the groove, resistance wire 40 is located eccentrically in the metal envelope of the heating element, being disposed closer to hotplate 82. This configuration, independent of the conformation of the wire to the form of the groove permits heating to be localized mainly at the level of the hotplate, thus reducing radiation away from the hotplate.

For the same purpose, there is provided a particular surface treatment of the heating element in order for it to have an elevated emmissivity on the surface in contact with the hotplate and a lower emmissivity elsewhere.

Figure 5:
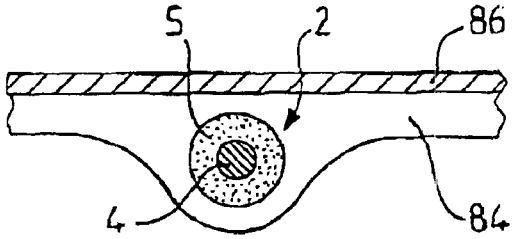

There can equally be provided, as shown in FIG. 5, an overmolding of heating element 2 by diffusion plate 84, heating element 2 being disposed on hotplate 86. Hotplate 86 may be provided with a positioning groove or not.

Figure 6:
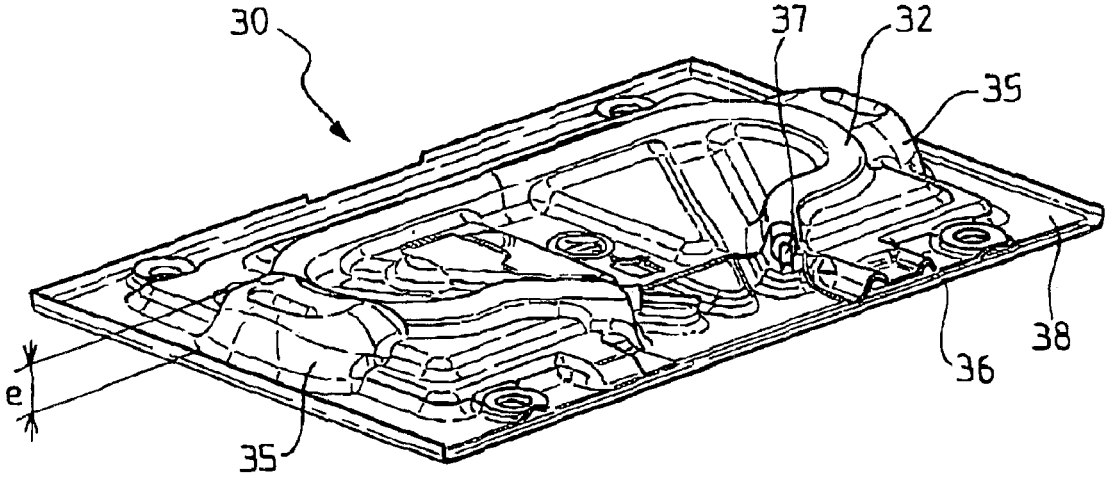
FIG. 6 is a perspective view of a hotplate equipped with a heating element according to the present invention.

FIG. 6 shows an advantageous practical embodiment for improved thermal transfer between the heating element and the hotplate. A heating sub-assembly 30 has a hotplate 36, a heating element 37 and a diffusion plate 38. Heating element 37 has a resistance wire with a high PTC effect according to one of the characteristics previously described.

Hotplate 36 has at least one cavity having at least one recess corresponding to the form of the food to be cooked. The assembly of recesses of hotplate 36 forms the cooking zone of hotplate 36.

Heating element 37 is disposed against the face of hotplate 36 that is opposite to the face having the recesses. The form of heating element 37 is adapted to the surface of the cooking zone and to the width and to the length of the hotplate 36, forming a loop.

Diffusion plate 38 has a housing 32 which mates with the form of heating element 37 and is adapted to receive it, Thus heating element 36 is sandwiched between hotplate 36 and diffusion plate 38.

Diffusion plate 38 is shaped in a manner such that it mates, over at least a predetermined height e, with at least a part of the ensemble of the recesses of the cavities of hotplate 36.

Thus, diffusion plate 38 comprises, in addition to housing 32 receiving heating element 37, a cavity 35 receiving hotplate 36 over the predetermined height e. In this manner, thermal exchanges between hotplate 36 and diffusion plate 38 are improved.

Preferably, hotplate 36 is made of a material that is a poor thermal conductor, for example stainless steel, and its thickness, substantially constant is between 0.6 and 0.8 mm. Such a hotplate can be easily made by stamping then by cutting of sheet metal. Prior to the stamping, the stainless steel plate can be coated with a non-stick material, such as PTFE, on the side that will be in contact with food to be cooked.

Preferably, diffusion plate 38 is made of a material that is a good thermal conductor, for example aluminum, and its thickness substantially constant, is comprised between 0.8 and 2 mm and preferably between 0.08 and 1 mm. Such a diffusion plate 38 can be made by stamping.

Diffusion plate 38 thus plays the role of a thermal diffuser by distributing by conduction the heat energy coming from heating element 37 over the part of hotplate 36 that is in contact with diffusion plate 38.

In the opposite direction, diffusion plate 38 aids the return to heating element 37 of information relating to the thermal state of hotplate 36, or, in other words, allows the temperature of the heating element to approach that of the hotplate, which improves the regulation reaction of the heating assembly. This aspect is even greater when the hotplate is made of steel which has a low thermal conductivity generating a substantial thermal inertia.

The assembly of hotplate 36 with diffusion plate 38 can be effected by solder, welding, brazing, cementing, or, preferably for reasons of cost, by means of rivets or screw. Preferably hotplate 36 and diffusion plate 38 are fixed against one another by crimping, i.e. by mutual deformation or a common stamping: embedding of hotplate 36 in diffusion plate 38 permits achievement of a better maintenance of the increase and decrease in temperature despite the difference in expansion between the two metals used.

The present invention is not limited to the examples described or to a heating element equipping a bread grilling devise. Such a heating element and its associated self-regulating capabilities can equally be employed in other types of electric appliance for heating, cooking, or grilling of food by contact, such as barbeques, crepe makers, meat grills, as well as in water heating appliances such as coffee makers, boilers, or even pressing irons, in order to equally avoid excessive heating when dry.

A preferred embodiment of the invention may be as follows:

the resistance wire may be made of a composition having the trade name Kanthal 70, marketed by the Kanthal company of Group Sandvik, this wire having a composition of 70% Ni and 30% Fe, the resistance wire may have a diameter of 0.18 mm, the diameter of the wire spiral is 3.8 mm and the inner metal tube diameter is 5.05 mm, the composition of the insulating material is pure magnesia (99.3%), the rest being impurities, the value of the voltage that will be applied to the wire is 115V, and the overall dimensions of the cooking plate is 131 mm by 231 mm.

This application relates to subject matter disclosed in French Application Number 02 13251, filed Oct. 23, 2002, the disclosure of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A heating element for an electric appliance for heating or cooking foods, said heating element comprising:

a tubular metal envelope; and a resistance wire encased in an insulator disposed at the interior of said tubular envelope, said wire being composed of nickel and iron as the two principal elements, said wire having a temperature coefficient $\alpha$ greater than 1500 ppm/° C., wherein said wire is wound in a spiral and the outer diameter of the spiral is greater than 0.7 times the inner diameter of the tubular envelope.

2. The heating element of claim 1 wherein the temperature coefficient $\alpha$ is greater than 3000 ppm/° C.

3. The heating element of claim 1 wherein said wire has a nickel content greater than 40%.

4. An electric appliance for heating or cooking foods, said appliance comprising:

at least one hotplate for the foods; and a heating element coupled to said hotplate for heating said hotplate, wherein said heating element comprises:

a tubular metal envelope; and a resistance wire encased in an insulator disposed at the interior of said tubular envelope, said wire being composed of nickel and iron as the two principal elements, and said wire having a temperature coefficient $\alpha$ greater than 1500 ppm/° C., wherein said wire is wound in a spiral and the outer diameter of the spiral is greater than 0.7 times the inner diameter of the tubular envelope.

5. The electric appliance of claim 4, wherein the temperature coefficient $\alpha$ is greater than 3000 ppm/° C.

6. The electric appliance of claim 4, wherein said wire has a nickel content greater than 40%.

7. The electric appliance of claim 6, wherein said wire has a resistance selected so that the heat generated by electric power supplied to said heating element provokes an increase in the resistance of said wire up to an equilibrium value corresponding to a temperature of the hotplate that is the operating temperature of the hotplate to heat or cook foods.

8. The electric appliance of claim 4, wherein said wire has a resistance that is created by giving said wire at least one of a selected length and a selected diameter.

9. The electric appliance of claim of claim 4, wherein the power converted to heat by said heating element at the temperature required by said hotplate for heating or cooking foods is between 0.4 and 0.7 times the power converted to heat by the heating element at ambient temperature for a given supply voltage to the heating element, the power difference being uniquely determined by the resistance and the temperature coefficient of said wire.

10. The electric appliance of claim 4, further comprising means for aiding thermal exchange between said heating element and said hotplate.

11. The electric appliance of claim 10, wherein said means for aiding thermal exchange comprise a groove in said hotplate, said groove housing said heating element.

12. The electric appliance of claim 11, wherein said groove surrounds said heating element around at least one-half of the perimeter of said tubular envelope of said heating element.

13. The electric appliance of claim 11, wherein said heating element is compressed in said groove in order to increase the surface area of contact between said heating element and said groove.

14. The electric appliance of claim 11, wherein parts of said heating element in contact with said hotplate have a surface emissivity greater than parts of said heating element that are not in contact with said hotplate.

15. The electric appliance of claim 11, further comprising a diffusion plate covering parts of said heating element that are not in contact with said hotplate, said diffusion plate being made of a material that is a good thermal conductor.

16. The electric appliance of claim 15, wherein the material of said diffusion plate is aluminum or copper.

17. The electric appliance of claim 15, wherein said diffusion plate is also in contact with said hotplate and extends over a significant part of the surface area of said hotplate.

18. The electric appliance of claim 11, wherein said resistance wire is positioned eccentrically at the interior of said tubular envelope.

19. The electric appliance of claim 10, wherein the said means for aiding thermal exchange between said heating element and said hotplate allows said heating element to respond quickly to any variation in temperature of the hotplate, leading automatically to a modification of the power that is dissipate by said heating element.

* * * * *